US009236688B2

(12) United States Patent
Friedhof

(10) Patent No.: US 9,236,688 B2
(45) Date of Patent: Jan. 12, 2016

(54) ELECTRICAL CONNECTORS HAVING DIFFERENTIAL PAIRS

(71) Applicant: Tyco Electronics Services GmbH, Schaffhausen (CH)

(72) Inventor: James Friedhof, Vista, CA (US)

(73) Assignee: TYCO ELECTRONICS SERVICES GmbH, Schaffhausen (CH)

( * ) Notice: Subject to any disclaimer, the term of this patent is extended or adjusted under 35 U.S.C. 154(b) by 161 days.

(21) Appl. No.: 13/900,688

(22) Filed: May 23, 2013

(65) Prior Publication Data

US 2014/0235105 A1 Aug. 21, 2014

Related U.S. Application Data

(60) Provisional application No. 61/765,492, filed on Feb. 15, 2013.

(51) Int. Cl.

| | |
|---|---|
| ***H01R 13/648*** | (2006.01) |
| ***H01R 13/6461*** | (2011.01) |
| ***H01R 9/03*** | (2006.01) |
| ***H01R 13/533*** | (2006.01) |

(Continued)

(52) U.S. Cl.

CPC ..... *H01R 13/6461* (2013.01); *H01R 9/035* (2013.01); *H01R 13/533* (2013.01); *H01R 13/6588* (2013.01); *H01R 24/86* (2013.01); *H01R 13/514* (2013.01); *H01R 13/6592* (2013.01); *H01R 2201/04* (2013.01)

(58) Field of Classification Search

CPC ..... H01R 13/6581; H01R 13/6593; H01R 23/6873; H01R 13/506; H01R 13/516; H01R 13/514; H01R 13/6592; H01R 13/518; H01R 13/6586; H01R 43/20; H01R 9/032; H01R 13/502

USPC ..... 439/607.55, 607.5, 607.53, 695, 701

See application file for complete search history.

(56) References Cited

U.S. PATENT DOCUMENTS 6,494,743 B1 * 12/2002 Lamatsch et al. ..... 439/607.05
7,316,584 B2 * 1/2008 Mackillop et al. ..... 439/607.05

(Continued)

FOREIGN PATENT DOCUMENTS

WO 98/28822 A1 7/1998
WO 2012/172844 A1 12/2012

OTHER PUBLICATIONS

European Search Report, Mail Date May 12, 2014, EP 14 15 5169, Application No. 14155169.7-1801.

(Continued)

*Primary Examiner* — Xuong Chung Trans

(57) ABSTRACT

An electrical connector includes a conductive shell having a chamber and having a mating end and a cable end. An insert assembly is received in the chamber and includes a module having a plurality of channels. The module is conductive and provides peripheral electrical shielding entirely around each of the channels for an entire length of each of the channels. The module engages and is electrically commoned with the shell. The insert assembly also includes insulator housings each holding a pair of contacts. The insulator housings are received in corresponding channels and electrically insulate the contacts from the module. Each pair of contacts is electrically shielded from each other pair of contacts by the module. A backshell is coupled to the cable end of the shell and holds the insert assembly in the chamber of the shell.

19 Claims, 8 Drawing Sheets

(51) Int. Cl.

| | |
|---|---|
| ***H01R 13/6588*** | (2011.01) |
| ***H01R 24/86*** | (2011.01) |
| *H01R 13/514* | (2006.01) |
| *H01R 13/6592* | (2011.01) |

(56) References Cited

U.S. PATENT DOCUMENTS

| | | | | |
|---|---|---|---|---|
| 7,736,159 | B1 | 6/2010 | Effinger, III et al. | |
| 8,226,431 | B2 * | 7/2012 | Reimchen | 439/459 |
| 8,241,068 | B2 * | 8/2012 | Millard et al. | 439/660 |
| 8,591,268 | B2 * | 11/2013 | Reimchen | 439/701 |
| 8,771,012 | B2 * | 7/2014 | Le Tortorec et al. | 439/584 |
| 2007/0259568 | A1 | 11/2007 | Mackillop et al. | |
| 2012/0034809 | A1 | 2/2012 | Reimchen | |
| 2012/0238126 | A1 | 9/2012 | Damodharan et al. | |
| 2014/0302724 | A1 * | 10/2014 | Ono | 439/751 |

OTHER PUBLICATIONS

OCS (Oval Contact Connector System) Connectors, Amphenol Aerospace offers the High Performance Interconnect Solution for your High Speed Needs, Amphenol Aerospace, PDS-234-1, Jan. 2013, 7 pgs, USA.

* cited by examiner

ELECTRICAL CONNECTORS HAVING DIFFERENTIAL PAIRS

CROSS REFERENCE TO RELATED APPLICATIONS

This application claims the benefit of U.S. Provisional Application No. 61/765,492 filed Feb. 15, 2013, the subject matter of which is herein incorporated by reference in its entirety.

BACKGROUND OF THE INVENTION

The subject matter herein relates generally to electrical connectors having differential pairs.

With the increasing demand and complexity of modern electronic systems in high reliability applications such as military and aerospace, there is a continuing need to incorporate more electronic equipment into a confined space, while at the same time ensuring reliability in harsh environments. In such applications, connector systems provide a critical communication link between physically separated electronic devices. Connector systems have to satisfy many competing requirements. For example, electrical connectors may need to be capable of withstanding a rugged environment that includes vibration, wide temperature swings, moisture, and exposure to hazardous materials and chemical contaminants. Electrical connectors may need to be compact to permit many interconnections to be made within a small area and include a small number of individual pieces. Electrical connectors may need to have high quality electrical characteristics, with matched impedance, very low signal loss, and minimal crosstalk. Electrical connectors may need to be field repairable with individual contacts being replaceable so as to not have to replace the entire electrical connector.

High reliability connector systems are often used to facilitate 100Base T, 1000Base T and 10 GBase T Ethernet applications such as those found in commercial avionics systems. Additional applications, for example, include aircraft data networks, in-flight entertainment systems (IFE) and other mil-aero networking applications where Gigabit Ethernet IEEE 802.3, Fiber Channel XT11.2, 1394, USB, 1553, Fiber Channel, VME, Can-Buss, J1708 or other multi-gigabit connectivity architecture is required. In such communication networks in which it is desirable to transfer data at high speeds over distances up to one-hundred meters, it is known to use balanced matched impedance copper cabling. The copper cables are connected to the various interfaces in a communications network using plug-in modular electrical connectors. A conventional cable used to transfer data includes an insulating cable sheath that contains pairs of copper wires. The pairs of wires are twisted together in order to reduce crosstalk. The Ethernet protocol uses four pairs per channel, and each pair needs to be shielded from the other pairs to preclude cross-talk between the pairs. Furthermore, when the channel is used in a full duplex manner, i.e., to support simultaneous bidirectional communications, it is also necessary to prevent disturbance by near end crosstalk and far end crosstalk from the other pairs. Thus, in a given Ethernet channel, there are six disturbing sources per pair. Consequently, both the position of the wires and the components of the modular connector all play a role in preventing signal degradation.

A need remains for an improved matched-impedance, shielded-pair interconnection system for high speed data transmission for harsh operating environments that may be packaged in a minimal form factor.

BRIEF DESCRIPTION OF THE INVENTION

In one embodiment, an electrical connector is provided that includes a shell having a chamber and having a mating end and a cable end. The shell is conductive and provides electrical shielding. An insert assembly is received in the chamber and includes a module having a plurality of channels. The module is conductive and provides peripheral electrical shielding entirely around each of the channels for an entire length of each of the channels. The module engages and is electrically commoned with the shell. The insert assembly also includes insulator housings each holding a pair of contacts. The insulator housings are received in corresponding channels and electrically insulate the contacts from the module. Each pair of contacts is electrically shielded from each other pair of contacts by the module. A backshell is coupled to the cable end of the shell and holds the insert assembly in the chamber of the shell.

Optionally, the module may be cylindrical and extend between a front and a rear with the channels extending between the front and the rear. Each of the channels may be entirely peripherally surrounded by the module between the front and the rear. The channels may be arranged symmetrically about a horizontal axis and about a vertical axis. Optionally, an equal number of channels are arranged in each quadrant of the module. The channels may have an oval shaped crossed section.

Optionally, the shell includes an interior wall in the chamber having channels aligned with the channels of the module. The channels of the interior wall and the channels of the module may receive mating contacts of a plug configured to be mated with the electrical connector.

Optionally, the back shell may be threadably coupled to the cable end of the shell. The insert assembly may be sandwich between the shell and the back shell when the back shell is coupled to the shell. The insert assembly may be directly electrically coupled to the shell and the back shell to create electrical continuity for the electrical shielding along the entire length of the electrical connector.

Optionally, the contacts may be removably coupled within the corresponding insulator housings. The contacts may be crimped to ends of wires. The contacts may be entirely contained within the insulator housing along an entire length of each contact. The contacts may have mating ends extending forward of fronts of the corresponding insulator housing. The fronts of the insulator housing may be recessed rearward of a front of the module. The mating ends of the contacts may be contained within the channels of the module to protect the mating ends.

Optionally, the insert assembly may include a cable support reward of the module. The cable support may support cables holding wires terminated to corresponding contacts. The cable support may be conductive and provides electrical shielding for the cables and wires passing through the cable support. The cable support may include cable channels receiving corresponding cables and wires. Cable braids of the cables may be directly electrically coupled to the cable support within the cable channels. A strap may be coupled to the cable support. The strap may secure the cables to the cable support. The strap may be conductive and may engage the cable braids of the cables. The strap may electrically common the cable braids to the cable support. The cable support and the module may both be received in the chamber. The back shell may hold the cable support and module in the chamber.

DETAILED DESCRIPTION OF THE INVENTION

Embodiments described herein may include an electrical connector having matched impedance shielded contact pairs for high-speed data transmission. Embodiments described herein may include ruggedize electrical connectors capable of withstanding a rugged environment that includes vibration, wide temperature swings, moisture, and exposure to hazardous materials and chemical contaminants Embodiments described herein may include electrical connectors that are compact to permit the electrical connector to be located in a small area and/or to permit many electrical connectors to be provided in a small area. Embodiments described herein provide electrical connectors having a small number of individual pieces assembled together as compared to conventional electrical connectors. Embodiments described herein provide electrical connectors that have high quality electrical characteristics, such as matched impedance, very low signal loss, minimal cross talk and the like. Embodiments described herein provide electrical connectors that are field repairable and have individual contacts that are replaceable so as to not have to replace the entire electrical connector.

Figure 1:
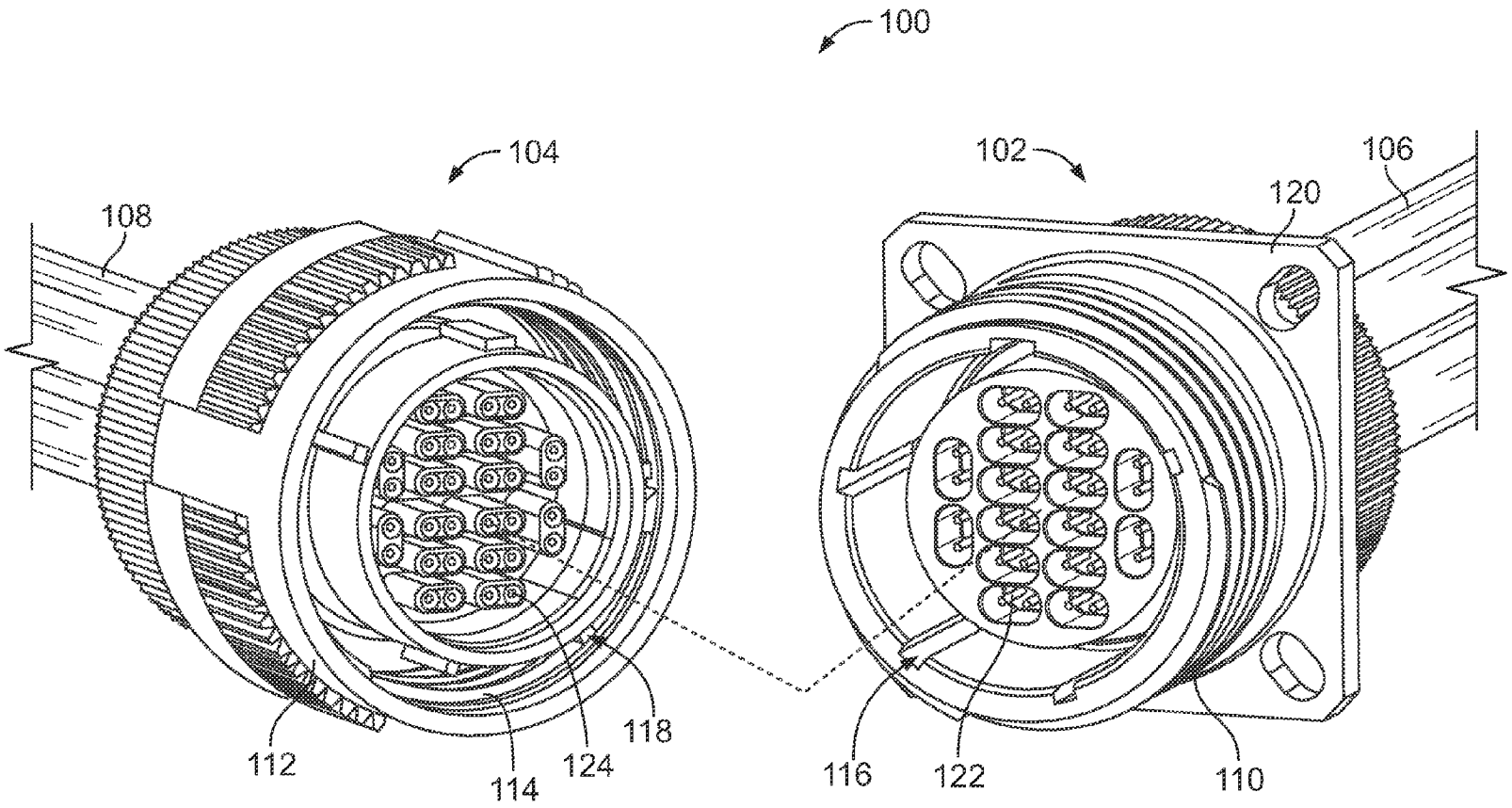
FIG. 1 illustrates a connector system formed in accordance with an exemplary embodiment.

FIG. 1 illustrates a connector system 100 formed in accordance with an exemplary embodiment. The connector system 100 includes a first electrical connector 102 and a second electrical connector 104 arranged to be coupled together to form an electrical connection between a plurality of pairs of conductors. The first and second electrical connectors 102, 104 are cable mounted electrical connectors provided at ends of corresponding cables 106, 108, respectively. Optionally, multiple cables 106 may be terminated to the electrical connector 102. Optionally, multiple cables 108 may be terminated to the electrical connector 104. Optionally, each cable 106, 108 may include a plurality of individual wires terminated to corresponding conductors. In an exemplary embodiment, the wires may be arranged in pairs. Optionally, the wires may be twisted pairs. The electrical connectors 102, 104 provide electrical shielding for the conductors and/or wires and/or cables held therein. In an exemplary embodiment, each pair of conductors may be shielded from other pairs throughout the electrical connectors 102, 104.

In an exemplary embodiment, the first electrical connector 102 may include a receptacle configured to receive a portion of the second electrical connector 104. The first electrical connector 102 may be referred to hereinafter as a receptacle connector 102 or simply a receptacle 102. The second electrical connector 104 is configured to be plugged into the first electrical connector 102. The second electrical connector 104 may be referred to herein after as a plug connector 104 or simply a plug 104. Some embodiments of connectors described herein may be designed to fit 16 pairs of conductors in a size 17 ruggedized connector, whereas conventional connectors were only able to fit such high number of pairs in a size 25 connector.

In an exemplary embodiment, the first and second electrical connectors 102, 104 are coupled together by a threaded connection. The receptacle 102 includes an external thread 110. The plug 104 includes a collar 112 that is rotatable and includes an internal thread 114. The plug 104 is plugged into the receptacle 102 and the collar 112 is threadably coupled thereto. The internal thread 114 of the collar 112 engages the external thread 110 of the receptacle 102. The collar 112 is rotated and tightened to secure the plug 104 to the receptacle 102. Other types of securing means may be used in alternative embodiments. For example, the receptacle 102 and/or plug 104 may include bayonet connectors. The receptacle 102 and plug 104 may be quick connect type of connectors having releasable ball bearings or other securing means to secure the plug 104 to the receptacle 102.

In an exemplary embodiment, the electrical connectors 102, 104 may include keying features. For example, the receptacle 102 may include keyways 116 that receive corresponding keys 118 of the plug 104. The keys 118 and keyways 116 may orient the plug 104 with respect to the receptacle 102. The keyways 116 and keys 118 may resist rotation of the plug 104 with respect to the receptacle 102 once mated. The keyways 116 and keys 118 may have different widths to orient the plug 104 with respect to the receptacle 102.

In an exemplary embodiment, the first electrical connector 102 includes a mounting flange 120 used for mounting the first electrical connector 102 to a flat surface, such as an item of electrically equipment, a utility rack, a junction box, a bulk head, a wall, a panel or another surface. A portion of the first electrical connector 102 may extend through the item to which the mounting flange 120 is affixed, such as through an opening of such item.

Contacts 122 are held in the receptacle 102. In an exemplary embodiment, the contacts 122 are arranged in pairs. Optionally, the contacts 122 may carry differential pair signals. In the illustrated embodiment, the contacts 122 are pin contacts; however other types of contacts 122 may be used in alternative embodiments. The plug 104 includes a plurality of contacts 124 held in the plug 104. The plug 104 provides electrical shielding for the contacts 124. In an exemplary embodiment, the contacts 124 are arranged in pairs. Optionally, the contacts may be differential pairs. In the illustrated embodiment, the contacts 124 are socket contacts however other types of contacts may be used in alternative embodiments.

Figure 2:
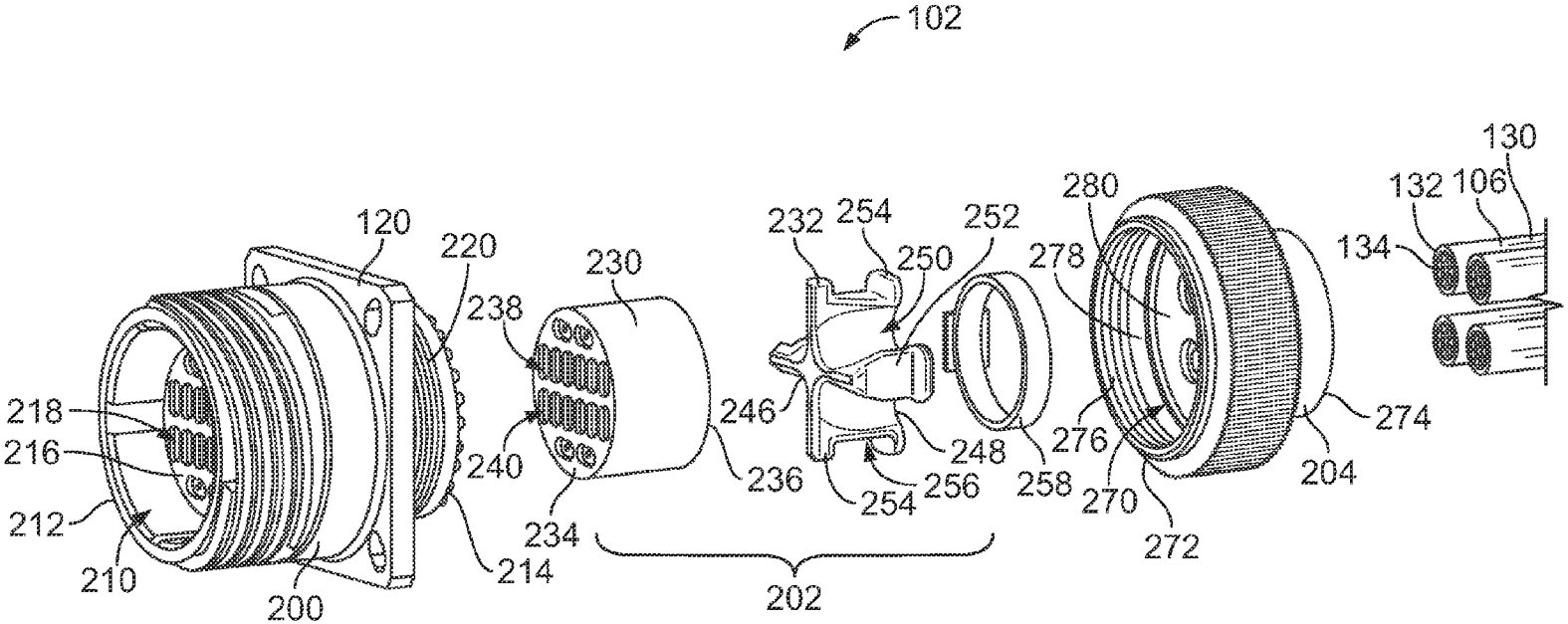
FIG. 2 is an exploded view of a receptacle of the connector system.

FIG. 2 is an exploded view of the receptacle 102 and a plurality of the cables 106. Each cable 106 includes a jacket 130 at an exterior of the cable 106 and a cable braid 132 inside the jacket 130 and providing electrical shielding for individual wires 134 contained within the jacket 130. Optionally, the wires 134 may be individually shielded, such as with separate wires shields. In an exemplary embodiment the wires 134 are arranged in pairs. Optionally, the wires 134 may be twisted pairs. The wires 134 are configured to be terminated to corresponding contacts 122 (shown in FIG. 1) of the receptacle 102.

The receptacle 102 includes a shell 200, an insert assembly 202, and a back shell 204. The insert assembly 202 is configured to be received inside the shell 200. The back shell 204 is used to secure the insert assembly 202 within the shell 200. The cables 106 may pass through the back shell 204 for connection to the contacts 122 which are held by the insert assembly 202.

The shell 200 includes a chamber 210 extending between a mating end 212 and a cable end 214 of the shell 200. The chamber 210 is sized and shaped to receive the insert assembly 202. In an exemplary embodiment, the shell 200 includes an internal wall 216 separating the chamber 210 into a front chamber segment and a rear chamber segment. The front chamber segment is provided at the mating end 212 and the rear chamber segment is provided at the cable end 214. The front chamber segment is configured to receive a portion of the plug 104. The rear chamber segment is configured to receive the insert assembly 202. In an exemplary embodiment, the internal wall 216 includes a plurality of channels 218 extending therethrough. The contacts 122 may be exposed through the channels 218 for mating with the contacts 124 (shown in FIG. 1) of the plug 104 (shown in FIG. 1).

The external threads 110 are provided on the exterior of the shell 200 proximate to the mating end 212. The mounting flange 120 extends outward from the shell 200 and may be approximately centered along the shell 200 between the mating end 212 and the cable end 214. In an exemplary embodiment, the shell 200 includes external threads 220 rearward of the mounting flange 120. The external threads 220 are used to secure the back shell 204 to the shell 200. Other types of securing features may be used in alternative embodiments other than external threads 220 to secure the back shell 204 to the shell 200.

The insert assembly 202 includes a module 230 and a cable support 232. In an exemplary embodiment, the cable support 232 is separate and discrete from the module 230, however the cable support 232 may be integral with the module 230 in alternative embodiments.

The module 230 extends between a front 234 and a rear 236. In an exemplary embodiment, the module 230 is cylindrical between the front 234 and the rear 236. The module 230 includes a plurality of channels 238 extending therethrough between the front 234 and the rear 236. In an exemplary embodiment, the module 230 is conductive. For example, the module 230 may be manufactured from a metal material or a metalized composite material. The body of the module 230 provides electrical shielding for each of the channels 238. The contacts 122 are received in corresponding channels 238 and are electrically shielded by the module 230. The module 230 provides peripheral electrical shielding entirely around each of the channels 238 for an entire length of each of the channels 238 defined between the front 234 and the rear 236. When the module 230 is loaded into the shell 200 the module 230 engages and is electrically commoned with the shell 200 to create electrical continuity for the electrical shielding of the contacts 122.

The insert assembly 202 includes a plurality of insulator housings 240. The insulator housing 240 each hold a pair of the contacts 122. The insulator housings 240 are received in corresponding channels 238 and electrically insulate the contacts 122 from the body of the module 230. Each insulator housing 240 and corresponding pair of contacts 122 is electrically shielded from each other insulator housing 240 and corresponding pair of contacts 122 by the module 230. In an exemplary embodiment, the channels 238 are oval shaped, however the channels 238 may have other shapes and alternative embodiments. The size and shape of the channels 238 may be designed to provide a matched impedance to the cable and conductors and/or for signal integrity. The spacing of the contacts 122 and the insulator material may be designed to provide a matched impedance and/or for signal integrity. The insulator housing 240 have complementary shapes to the channels 238. Optionally, the insulator housings 240 may be held in the channels 238 by an interference fit. Alternatively, the insulator housings 240 may be held in the channels 238 by other securing means. In an exemplary embodiment, the module 230 and insulator housings 240 may be prepackaged with the insulator housings 240 already preloaded into the module 230. The contacts 122 need only to be loaded into the insulator housings 240. The number of loose parts with such a design is reduced and assembly and field repairability are easier with such a design.

The cable support 232 includes a plurality of cable channels 250 configured to receive corresponding cables 106. The cable channels 250 may be open along the sides of the cable support 232 such that the cables 106 may be side loaded into the cable support 232. The cable channels 250 may be sized and shaped to receive the cables 106. Optionally, the cable channels 250 may be curved and have diameters approximately equal to the corresponding diameters of the cables 106.

The cable support 232 includes side walls 252 at exterior portions of the cable support 232. Flanges 254 may extend from the side walls 252. Slots 256 are defined between front and rear flanges 254. The slots 256 receive a conductive strap 258 that is used to secure the cables 106 within the cable support 232. Optionally, the strap 258 may be conductive and may be electrically connected to the cable braids 132 of each of the cables 106. The strap 258 is used to press the cable braids 132 against the cable channels 250. The strap 258 may provide strain relief for the cables 106.

When the cables 106 are loaded into the cable channels 250, the cable braids 132 may be exposed along an exterior of the cable 106. The cable braids 132 engage the cable support 232 to electrically connect the cable braids 132 to the cable support 232. The cable support 232 provides electrical shielding between the cables 106. The cable support 232 is used to electrically common the cable braids 132 with the module 230, the shell 200 and/or the back shell 204. The cable support 232 creates electrical continuity for the electrical shielding between the cables 106 and the shell 200, module 230 and/or back shell 204.

In an exemplary embodiment, the cable support 232 is cross shaped having a horizontal member and a vertical member. The cable channels 250 are provided in four quadrants of the cable support 232. The horizontal and vertical members separate the cable channels 250 from one another. Optionally, the cable support 232 may include more or less than four cables cable channels 250.

The cable support 232 extends between a front 246 and a rear 248. The front 246 is configured to be pressed against the rear 236 of the module 230 when the insert assembly 202 is loaded into the shell 200. The rear 248 may be engaged by the back shell 204. The back shell 204 presses against the rear 248 to press the insert assembly 202 into the shell 200. The rear 248 may be electrically connected to the back shell 204 by a direct physical connection between the cable support 232 and the back shell 204. The cable support 232 may be electrically connected to the module 230 by a direct physical connection between the front 246 and the module 230.

The back shell 204 includes a chamber 270 extending between a mating end 272 and a cable end 274. The mating end 272 is configured to be coupled to the cable end 214 of the shell 200. Optionally, the back shell 204 may include internal threads 276 configured to engage the external threads 220 of the shell 200. The back shell 204 is tightened onto the shell 200 using the internal threads 276. The back shell 204 includes a shoulder 278 extending into the chamber 270. The shoulder 278 engages the rear 248 of the cable support 232 to dive the insert assembly 202 into the chamber 210 of the shell 200 during assembly. In an exemplary embodiment, the back shell 204 includes a gasket 280 held in the chamber 270. The gasket 280 may provide an environmental seal against the cables 106. The gasket 280 may provide strain relief for the cables 106. The cables 106 exit from the cable end 274 of the back shell 204 when the receptacle 102 is assembled.

Figure 3:
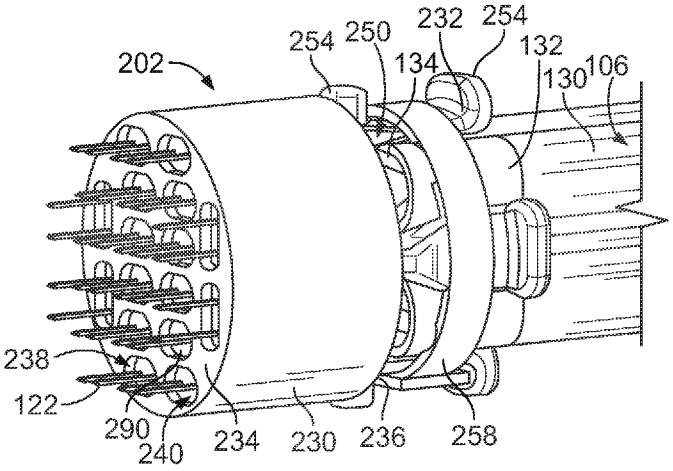
FIG. 3 is a front perspective view showing an insert assembly of the receptacle.

FIG. 3 is a front perspective view showing the insert assembly 202 mounted to the cables 106. During assembly, the contacts 122 are terminated to corresponding wires 134. In an exemplary embodiment, the contacts 122 are crimped to the wires 134; however other attachment means may be used in alternative embodiments. The contacts 122 are loaded into corresponding insulator housings 240. The insulator housings 240 are pre-loaded into corresponding channels 238 in the module 230. In an exemplary embodiment, when assembled, the contacts 122 extend forward from fronts 290 of each of the insulator housings 240. The contacts 122 extend forward form the front 234 of the module 230. The fronts 290 of the insulator housings 240 may be recessed into the channels 238.

The cables 106 are prepared by stripping a portion of the jacket 130 to expose the cable braid 132 and wires 134. The wires 134 are terminated to the contacts 122. The cable braid 132 may be folded over the jacket 130 or alternatively may just be exposed forward of the jacket 130. In the illustrated embodiment, the cable braid 132 is folded back over the jacket 130.

After assembling the contacts 122, the cable support 232 is positioned at the rear 236 of the module 230. In an exemplary embodiment, the cable support 232 abuts against the rear 236 of the module 230. The cables 106 are placed in the cable channels 250 of the cable support 232 such that the cable braids 132 are positioned in the cable channels 250. The strap 258 is tightened around the cables 106 and cable support 232 to secure the cables 106 in the cable support 232. In an exemplary embodiment, the strap 258 presses the cable braids 132 against the cable support 232 to electrically connect the cable braids 132 to the cable support 232. The strap 258 engages the cable braids 132 and the side walls 252 to electrically connect the cable braids 132 with the cable support 232. The flanges 254 hold the strap 258 in the slots 256.

Figure 4:
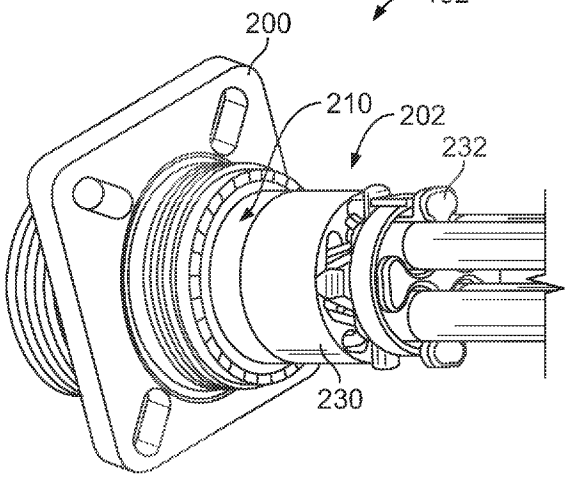
FIG. 4 illustrates the insert assembly being loaded into a shell of the receptacle.

FIG. 4 illustrates the insert assembly 202 being loaded into the shell 200. The chamber 210 is sized to receive the insert assembly 202. In an exemplary embodiment, both the module 230 and cable support 232 are received in the chamber 210. The overall length of the receptacle 102 is relatively short by having the module 230 and cables support 232 both received inside the shell 200, as opposed to having the cable support 232 reward of the shell 200, which would increase the length of the back shell 204 (shown in FIG. 2) and the overall length of the receptacle 102.

In an exemplary embodiment, the electrical connector 102 may have a modular design where different modules 230 and/or insert assemblies 202 may be loaded into the shell 200 to change the type of electrical connector 102. For example, the module 230 may hold different types of contacts to change the type of connector, different modules may arrange contacts in different arrangements or have a different number of contacts to change the type of connector. The different modules may have the same profile (e.g. size and shape) to fit in the shell 200 so that the different modules may be easily swapped out and replaced to change the type of connector.

Figure 5:
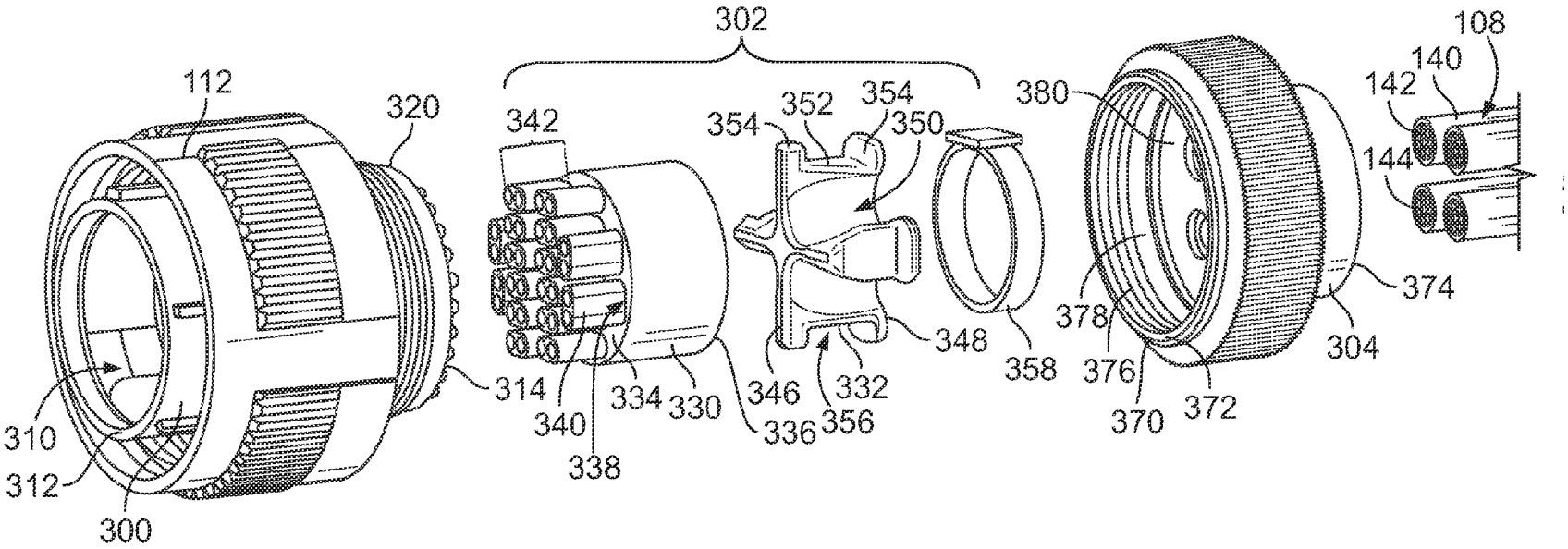
FIG. 5 is an exploded view of a plug of the connector system.

FIG. 5 is an exploded view of the plug 104 and a plurality of the cables 108. Each cable 108 includes a jacket 140 at an exterior of the cable 108 and a cable braid 142 inside the jacket 140 and providing electrical shielding for individual wires 144 contained within the jacket 140. Optionally, the wires 144 may be individually shielded, such as with separate wires shields. In an exemplary embodiment the wires 144 are arranged in pairs. Optionally, the wires 144 may be twisted pairs. The wires 144 are configured to be terminated to corresponding contacts 124 (shown in FIG. 1) of the plug 104.

The plug 104 includes a shell 300, an insert assembly 302, and a back shell 304. The insert assembly 302 is configured to be received inside the shell 300. The back shell 304 is used to secure the insert assembly 302 within the shell 300. The cables 108 may pass through the back shell 304 for connection to the contacts 124 which are held by the insert assembly 302.

The shell 300 includes a chamber 310 extending between a mating end 312 and a cable end 314 of the shell 300. The mating end 312 is configured to be plugged into the receptacle 102 (shown in FIG. 1). The chamber 310 is sized and shaped to receive the insert assembly 302. The collar 112 is rotatably coupled to the shell 300. In an exemplary embodiment, the collar 112 is located generally around the mating end 312 of the shell 300. In an exemplary embodiment, the shell 300 includes external threads 320 at the cable end 314 and rearward of the collar 112. The external threads 320 are used to secure the back shell 304 to the shell 300. Other types of securing features may be used in alternative embodiments other than external threads 320 to secure the back shell 304 to the shell 300.

The insert assembly 302 includes a module 330 and a cable support 332. In an exemplary embodiment, the cable support 332 is separate and discrete from the module 330, however the cable support 332 may be integral with the module 330 in alternative embodiments.

The module 330 extends between a front 334 and a rear 336. In an exemplary embodiment, the module 330 is cylindrical between the front 334 and the rear 336. The module 330 includes a plurality of channels 338 extending therethrough between the front 334 and the rear 336. In an exemplary embodiment, the module 330 is conductive. For example, the module 330 may be manufactured from a metal material or a metallized composite material. The body of the module 330 provides electrical shielding for each of the channels 338. The contacts 124 are received in corresponding channels 338 and are electrically shielded by the module 330. The module 330 provides peripheral electrical shielding entirely around each of the channels 338 for an entire length of each of the channels 338 defined between the front 334 and the rear 336. When the module 330 is loaded into the shell 300 the module 330 engages and is electrically commoned with the shell 300 to create electrical continuity for the electrical shielding of the contacts 124.

The insert assembly 302 includes a plurality of insulator housings 340. The insulator housing 340 each hold a pair of the contacts 124. The insulator housings 340 are received in corresponding channels 338 and electrically insulate the contacts 124 from the body of the module 330. Each insulator housing 340 and corresponding pair of contacts 124 is electrically shielded from each other insulator housing 340 and corresponding pair of contacts 124 by the module 330. In an exemplary embodiment, the channels 338 are oval shaped, however the channels 338 may have other shapes and alternative embodiments. The size and shape of the channels 238 may be designed to provide a matched impedance to the cable and conductors and/or for signal integrity. The spacing of the contacts 122 and the insulator material may be designed to provide a matched impedance and/or for signal integrity. The insulator housing 340 have complementary shapes to the channels 338. Optionally, the insulator housings 340 may be held in the channels 338 by an interference fit. Alternatively, the insulator housings 340 may be held in the channels 338 by other securing means. In an exemplary embodiment, mating portions 342 of the insulator housing 340 extend forward from the front 334 of the module 330. The mating portions 342 are configured to be plugged into the channels 218 and/or 238 (both shown in FIG. 2) of the receptacle 102. The channels 218, 238 provide electrical shielding for the corresponding mating portions 342.

The cable support 332 includes a plurality of cable channels 350 configured to receive corresponding cables 108. The cable channels 350 may be open along the sides of the cable support 332 such that the cables 108 may be side loaded into the cable support 332. The cable channels 350 may be sized and shaped to receive the cables 108. Optionally, the cable channels 350 may be curved and have diameters approximately equal to the corresponding diameters of the cables 108.

The cable support 332 includes side walls 352 at exterior portions of the cable support 332. Flanges 354 may extend from the side walls 352. Slots 356 are defined between front and rear flanges 354. The slots 356 receive a conductive strap 358 that is used to secure the cables 108 within the cable support 332. Optionally, the strap 358 may be conductive and may be electrically connected to the cable braids 142 of each of the cables 108. The strap 358 is used to press the cable braids 142 against the cable channels 350. The strap 358 may provide strain relief for the cables 108.

When the cables 108 are loaded into the cable channels 350, the cable braids 142 may be exposed along an exterior of the cable 108. The cable braids 142 engage the cable support 332 to electrically connect the cable braids 142 to the cable support 332. The cable support 332 provides electrical shielding between the cables 108. The cable support 332 is used to electrically common the cable braids 142 with the module 330, the shell 300 and/or the back shell 304. The cable support 332 creates electrical continuity for the electrical shielding between the cables 108 and the shell 300, module 330 and/or back shell 304.

In an exemplary embodiment, the cable support 332 is cross shaped having a horizontal member and a vertical member. The cable channels 350 are provided in four quadrants of the cable support 332. The horizontal and vertical members separate the cable channels 350 from one another. Optionally, the cable support 332 may include more or less than four cables cable channels 350.

The cable support 332 extends between a front 346 and a rear 348. The front 346 is configured to be pressed against the rear 336 of the module 330 when the insert assembly 302 is loaded into the shell 300. The rear 348 may be engaged by the back shell 304. The back shell 304 presses against the rear 348 to press the insert assembly 302 into the shell 300. The rear 348 may be electrically connected to the back shell 304 by a direct physical connection between the cable support 332 and the back shell 304. The cable support 332 may be electrically connected to the module 330 by a direct physical connection between the front 346 and the module 330.

The back shell 304 includes a chamber 370 extending between a mating end 372 and a cable end 374. The mating end 372 is configured to be coupled to the cable end 314 of the shell 300. Optionally, the back shell 304 may include internal threads 376 configured to engage the external threads 320 of the shell 300. The back shell 304 is tightened onto the shell 300 using the internal threads 376. The back shell 304 includes a shoulder 378 extending into the chamber 370. The shoulder 378 engages the rear 348 of the cable support 332 to dive the insert assembly 302 into the chamber 310 of the shell 300 during assembly. In an exemplary embodiment, the back shell 304 includes a gasket 380 held in the chamber 370. The gasket 380 may provide an environmental seal against the cables 108. The gasket 380 may provide strain relief for the cables 108. The cables 108 exit from the cable end 374 of the back shell 304 when the plug 104 is assembled.

Figure 6:
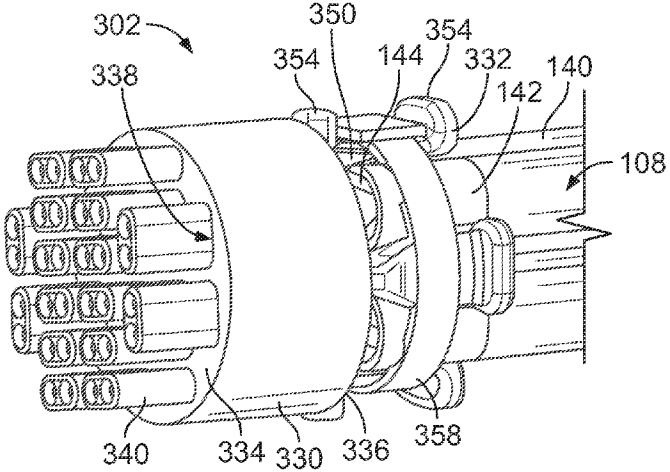
FIG. 6 is a front perspective view showing an insert assembly of the plug.

FIG. 6 is a front perspective view showing the insert assembly 302 mounted to the cables 108. During assembly, the contacts 124 (shown in FIG. 1) are terminated to corresponding wires 144. In an exemplary embodiment, the contacts 124 are crimped to the wires 144; however other attachment means may be used in alternative embodiments. The contacts 124 are loaded into corresponding insulator housings 340. The insulator housings 340 are loaded into corresponding channels 338 in the module 330. In an exemplary embodiment, when assembled, the contacts 124 are entirely surrounded by the insulator housings 340 along entire lengths of the contacts 124.

The cables 108 are prepared by stripping a portion of the jacket 140 to expose the cable braid 142 and wires 144. The wires 144 are terminated to the contacts 124. The cable braid 142 may be folded over the jacket 140 or alternatively may just be exposed forward of the jacket 140. In the illustrated embodiment, the cable braid 142 is folded back over the jacket 140.

After the contacts 124 and insulator housing 340 are loaded into the module 330, the cable support 332 is positioned at the rear 336 of the module 330. In an exemplary embodiment, the cable support 332 abuts against the rear 336 of the module 330. The cables 108 are placed in the cable channels 350 of the cable support 332 such that the cable braids 142 are positioned in the cable channels 350. The strap 358 is tightened around the cables 108 and cable support 332 to secure the cables 108 in the cable support 332. In an exemplary embodiment, the strap 358 presses the cable braids 142 against the cable support 332 to electrically connect the cable braids 142 to the cable support 332. The strap 358 engages the cable braids 142 and the side walls 352 to electrically connect the cable braids 142 with the cable support 342. The flanges 354 hold the strap 358 in the slots 356.

Figure 7:
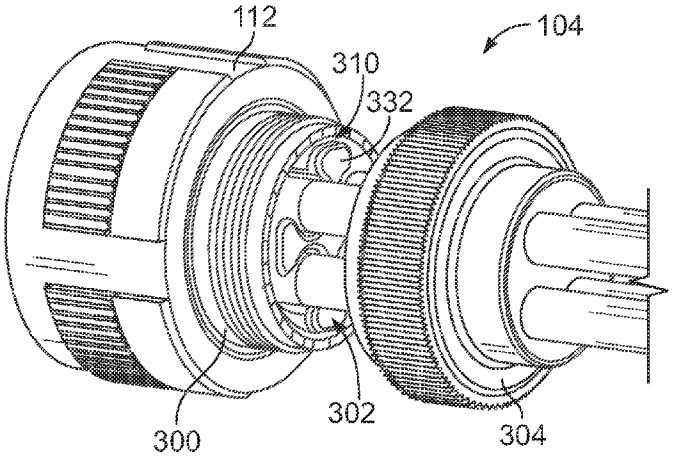
FIG. 7 illustrates the insert assembly being loaded into a shell of the plug.

FIG. 7 illustrates the insert assembly 302 loaded into the shell 300. The chamber 310 is sized to receive the insert assembly 302. In an exemplary embodiment, both the module 330 (shown in FIG. 5) and cable support 332 are received in the chamber 310. The overall length of the plug 104 is relatively short by having the module 330 and cables support 332 both received inside the shell 300, as opposed to having the cable support 332 reward of the shell 300, which would increase the length of the back shell 304 and the overall length of the plug 104.

In an exemplary embodiment, the electrical connector 104 may have a modular design where different modules 330 and/or insert assemblies 302 may be loaded into the shell 300 to change the type of electrical connector 104. For example, the module 330 may hold different types of contacts to change the type of connector, different modules may arrange contacts in different arrangements or have a different number of contacts to change the type of connector. The different modules may have the same profile (e.g. size and shape) to fit in the shell 300 so that the different modules may be easily swapped out and replaced to change the type of connector.

Figure 8:
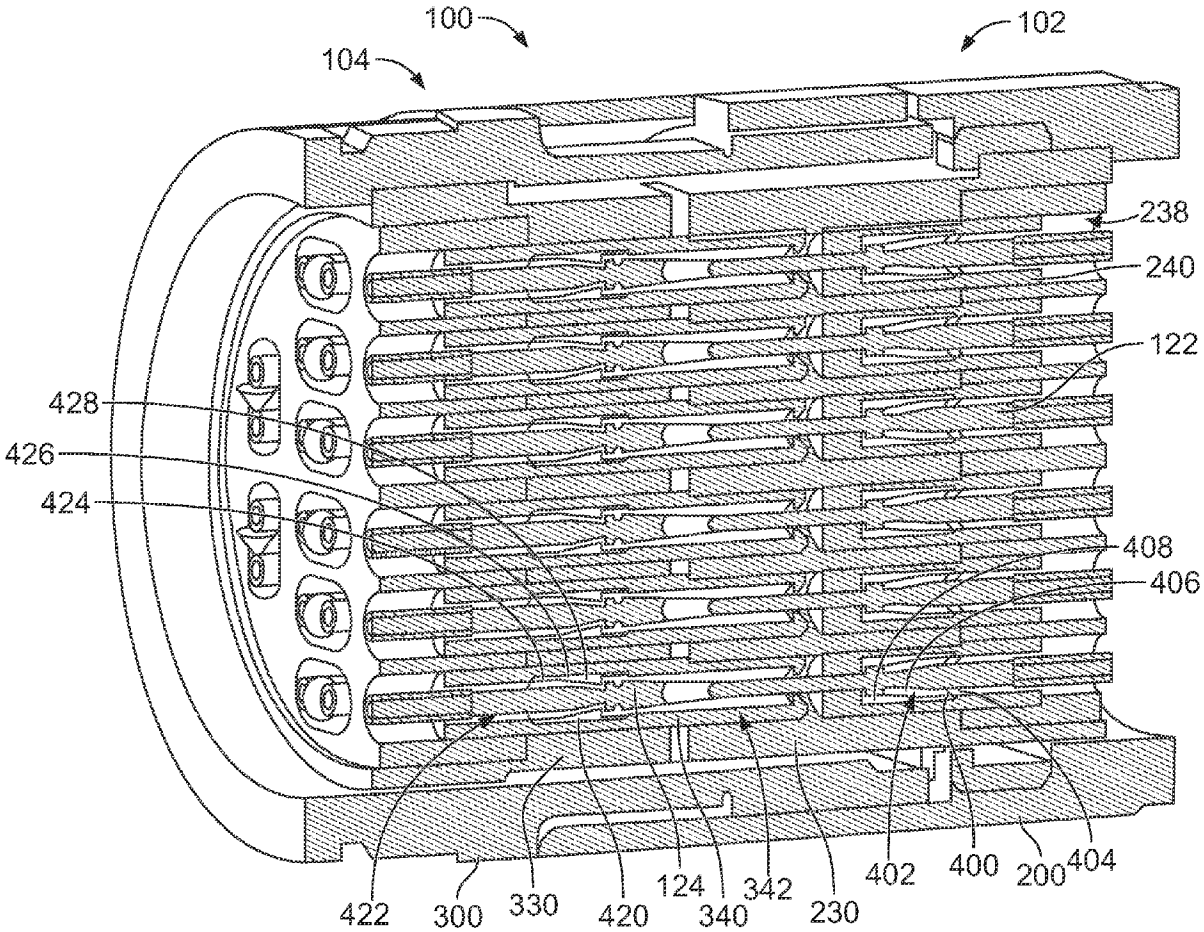
FIG. 8 is a cross sectional view of a portion of the connector system showing the plug mated with the receptacle.

FIG. 8 is a cross sectional view of a portion of the connector system 100 showing the plug 104 mated with the receptacle 102. The back shells 204, 304 (shown in FIGS. 2 and 5, respectively) are not illustrated in FIG. 8. The cable supports 232, 332, (both shown in FIGS. 2 and 5, respectively) are not shown in FIG. 8. FIG. 8 illustrates the shell 200 and the shell 300 with the modules 230, 330 loaded therein.

When assembled, the contacts 122 and insulator housings 240 are held in the module 230. The contacts 124 and insulator housings 340 are held in the module 330. The mating portions 342 of the insulator housings 340 are loaded into the channels 238 of the module 230. The module 230 provides electrical shielding around the mating portions 340 of the insulator housings 340 and the corresponding mating portions of the contacts 124.

In an exemplary embodiment, the contacts 122 are removably held in the insulator housing 240. The contacts 122 may be released from the insulator housing 240, such as to repair or replace the contacts 122. Such feature allows the receptacle 102 to be field repairable for a particular conductor and does not require discarding of the entire receptacle 102 if one or more of the contacts 122 are damaged or improperly functioning.

In the illustrated embodiment, a contact clip 400 is received in a bore 402 of the insulator housing 240 to hold the contact 122 and the bore 402. The contact clip 400 is held in the bore 402 against a shoulder 404 in the bore 402. The contact clip 400 includes tines 406 that engage reward facing shoulders 408 of the contacts 122. The tines 406 may be released to release the contact 122 from the bore 402. Other types of securing features may be used to hold the contacts 122 in the insulator housing 240. For example, the insulator housing 240 may be molded with integral latches that engage and hold the contacts 122 therein.

In the illustrated embodiment, a contact clip 420 is received in a bore 422 of the insulator housing 340 to hold the contact 124 and the bore 422. The contact clip 420 is held in the bore 422 against a shoulder 424 in the bore 422. The contact clip 420 includes tines 426 that engage reward facing shoulders 428 of the contacts 124. The tines 426 may be released to release the contact 124 from the bore 422. Other types of securing features may be used to hold the contacts 124 in the insulator housing 340. For example, the insulator housing 340 may be molded with integral latches that engage and hold the contacts 124 therein.

Figure 9:
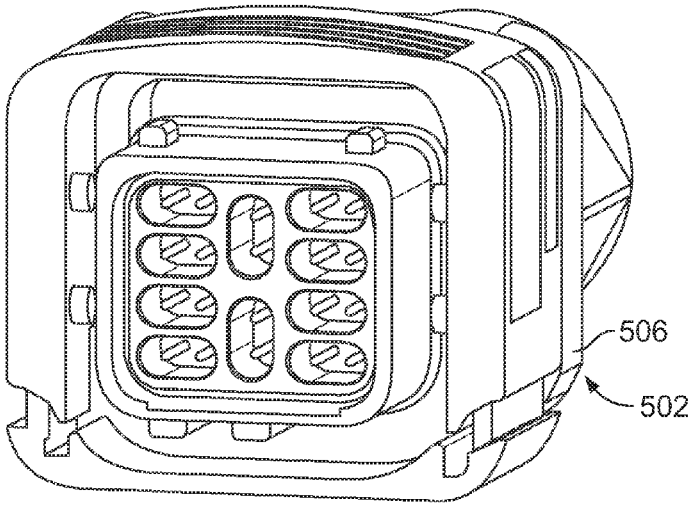
FIGS. 9 and 10 are front perspective views of an electrical connector formed in accordance with an exemplary embodiment.
Figure 10:
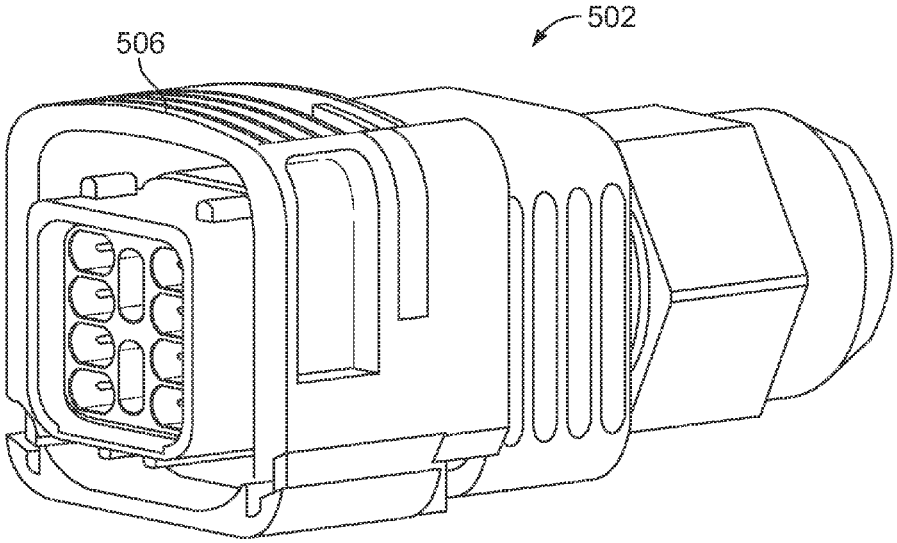
Figure 11:
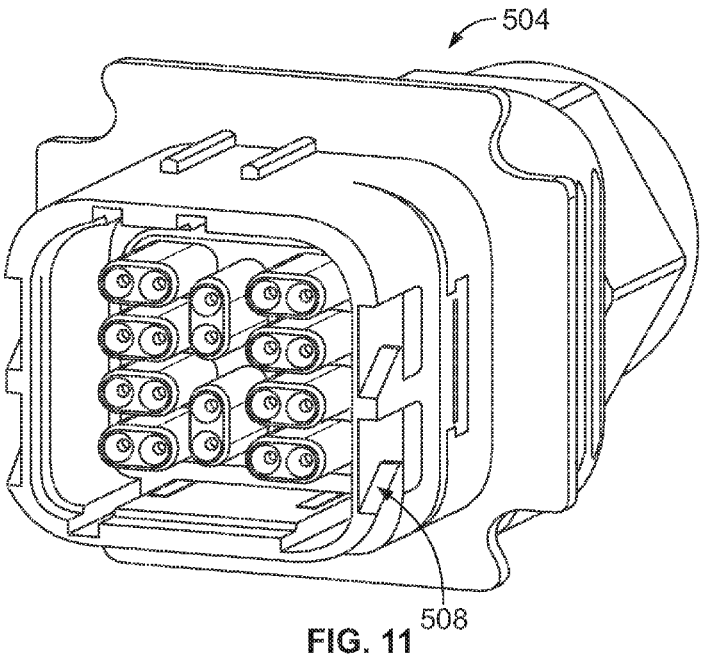
FIGS. 11 and 12 are front perspective views of an electrical connector formed in accordance with an exemplary embodiment and configured for mating with the electrical connector shown in FIGS. 9 and 10.
Figure 12:
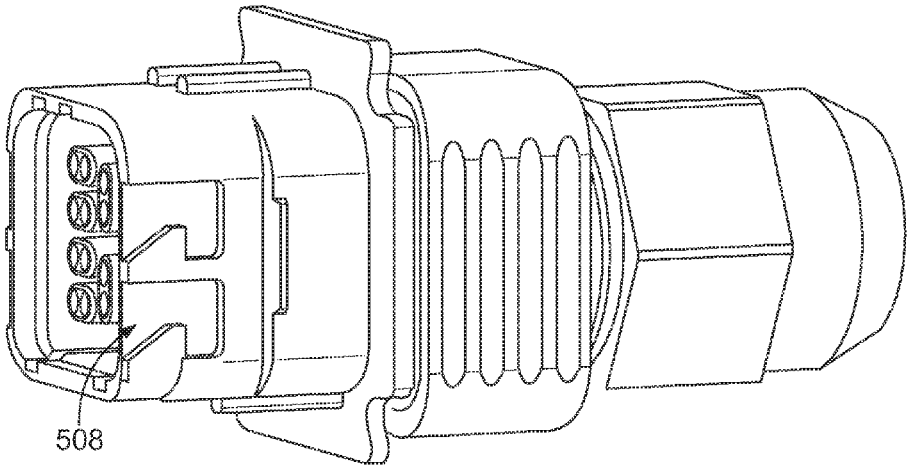

FIGS. 9 and 10 are front perspective views of an electrical connector 502 formed in accordance with an exemplary embodiment. FIGS. 11 and 12 are front perspective views of an electrical connector 504 formed in accordance with an exemplary embodiment and configured for mating with the electrical connector 502 shown in FIGS. 9 and 10. The electrical connector 502 may include a receptacle configured to receive a portion of the electrical connector 504 and may be referred to hereinafter as a receptacle connector 502 or simply a receptacle 502. The electrical connector 504 is configured to be plugged into the electrical connector 502 and may be referred to herein after as a plug connector 504 or simply a plug 504.

The receptacle 502 and plug 504 differ from the receptacle 102 and plug 104 (shown in FIG. 1) in that the receptacle 502 and plug 504 have a generally rectangular outer profile whereas the receptacle 102 and plug 104 have a generally cylindrical outer profile. The receptacle 502 and plug 504 have a different type of latching system to secure the receptacle 502 and plug 504 together. For example, the receptacle 502 includes a latch 506 and the plug 504 includes a catch 508 configured to receive the latch 506 and lock the receptacle 502 to the plug 504.

In an exemplary embodiment, the receptacle 502 and plug 504 both have pairs of conductors (e.g. contacts, wires, and the like) and the receptacle 502 and plug 504 provide electrical shielding for the pairs of conductors. For example, the receptacle 502 and plug 504 may both include modules and cable retainers that provide electrical shielding along lengths of the conductors to electrically shield pairs of the conductors from other pairs.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a shell having a chamber, the shell having a mating end and a cable end, the shell being conductive and providing electrical shielding;

an insert assembly received in the chamber, the insert assembly comprising a module having a plurality of channels, the module being conductive and providing peripheral electrical shielding entirely around each of the channels for an entire length of each of the channels, the module engaging and being electrically commoned with the shell, the insert assembly comprising insulator housings each holding a pair of contacts, the insulator housings entirely peripherally surrounding each pair of contacts for substantially an entire length of the insulator housings, the insulator housings being individually received in corresponding channels and electrically insulating the contacts from the module, each pair of contacts being electrically shielded from each other pair of contacts by the module, and the insert assembly comprising a cable support separate from the module and positioned reward of the module and a strap coupled to the cable support, the cable support supporting cables holding wires terminated to corresponding contacts and the strap securing the cables to the cable support, the strap being conductive and engaging cable braids of the cables to electrically common the cable braids using the strap; and a backshell coupled to the cable end of the shell, the backshell holding the insert assembly in the chamber of the shell.

2. The electrical connector of claim 1, wherein the cable support is conductive and provides electrical shielding for the cables and wires passing through the cable support.

3. The electrical connector of claim 1, wherein the cable support comprises cable channels receiving corresponding cables and wires, cable braids of the cables being directly electrically coupled to the cable support within the cable channels.

4. The electrical connector of claim 1, wherein the cable support is conductive, the strap electrically commoning the cable braids to the cable support.

5. An electrical connector comprising:

a shell having a chamber, the shell having a mating end and a cable end, the shell being conductive and providing electrical shielding;

an insert assembly received in the chamber, the insert assembly comprising a module having a plurality of channels, the insert assembly comprising insulator housings each holding a pair of contacts terminated to ends of wires extending from corresponding cables, the insulator housings being received in corresponding channels, and the insert assembly comprising a cable support separate from the module and positioned rearward of the module, the cable support having a plurality of cable channels receiving corresponding cables, wherein the module and the cable support are conductive and provide electrical shielding for the contacts and wires, cable braids of the cables being electrically connected to the cable support, the insulator housings insulating the contacts from the module; and a backshell coupled to the cable end of the shell, the backshell engaging the cable support to hold the insert assembly in the chamber of the shell.

6. The electrical connector of claim 5, wherein the module is cylindrical extending between a front and a rear, the channels extending between the front and the rear, each of the channels being entirely peripherally surrounded by the module between the front and the rear.

7. The electrical connector of claim 5, wherein the channels are arranged symmetrically about a horizontal axis and about a vertical axis.

8. The electrical connector of claim 5, wherein an equal number of channels are arranged in each quadrant of the module with a plurality of channels in each quadrant of the module.

9. The electrical connector of claim 5, wherein the channels have an oval shaped cross section and the insulator housings have an oval shaped cross section.

10. The electrical connector of claim 5, wherein the shell includes an interior wall in the chamber, the interior wall having channels aligned with the channels of the module, the channels of the interior wall and the channels of the module receiving mating contacts of a plug configured to be mated with the electrical connector.

11. The electrical connector of claim 5, wherein the contacts are removably coupled within the corresponding insulator housings.

12. The electrical connector of claim 5, wherein the contacts are crimped to ends of wires.

13. The electrical connector of claim 5, wherein the back shell is threadably coupled to the cable end of the shell.

14. The electrical connector of claim 5, wherein the insert assembly is sandwiched between the shell and the back shell when the back shell is coupled to the shell, the insert assembly being directly electrically coupled to the shell and the back shell to create electrical continuity for the electrical shielding along the entire length of the electrical connector.

15. The electrical connector of claim 5, wherein the contacts are entirely contained within the insulator housing along an entire length of each contact.

16. The electrical connector of claim 5, wherein the contacts have mating ends, the mating ends extend forward of fronts of the corresponding insulator housing, the fronts of the insulator housing being recessed rearward of a front of the module, the mating ends of the contacts being contained within the channels of the module to protect the mating ends.

17. The electrical connector of claim 5, further comprising a strap coupled to the cable support, the strap securing the cables to the cable support wherein, the strap being conductive and engaging the cable braids of the cables to electrically common the cable braids to the cable support.

18. The electrical connector of claim 5, wherein the cable support and the module are both received in the chamber, the back shell holding the cable support and module in the chamber.

19. An electrical connector system comprising:

a first electrical connector comprising a shell having a chamber, an insert assembly received in the chamber of the first electrical connector, and a backshell coupled to the shell of the first electrical connector to hold the insert assembly of the first electrical connector in the chamber of the shell of the first electrical connector, the insert assembly comprising a module having a plurality of channels, the module of the first electrical connector being conductive and providing peripheral electrical shielding entirely around each of the channels for an entire length of each of the channels of the first electrical connector, and the insert assembly of the first electrical connector comprising insulator housings each holding a pair of contacts, the insulator housings of the first electrical connector entirely peripherally surrounding each corresponding pair of contacts for substantially an entire length of the insulator housings, the insulator housings of the first electrical connector being received in corresponding channels such that each pair of contacts of the first electrical connector is electrically shielded from each other pair of contacts of the first electrical connector by the module of the first electrical connector; and a second electrical connector mated with the first electrical connector, the second electrical connector comprising a shell having a chamber, an insert assembly received in the chamber of the second electrical connector, and a backshell coupled to the shell of the second electrical connector to hold the insert assembly of the second electrical connector in the chamber of the shell of the second electrical connector, the insert assembly comprising a module having a plurality of channels, the module of the second electrical connector being conductive and providing peripheral electrical shielding entirely around each of the channels for an entire length of each of the channels of the second electrical connector, and the insert assembly of the second electrical connector comprising insulator housings each holding a pair of contacts, the insulator housings of the second electrical connector entirely peripherally surrounding each corresponding pair of contacts for substantially an entire length of the insulator housings, the insulator housings of the second electrical connector being received in corresponding channels such that each pair of contacts of the second electrical connector is electrically shielded from each other pair of contacts of the second electrical connector by the module of the second electrical connector;

wherein mating ends of the insulator housings and contacts of the second electrical connector extend forward of a front of the module, the mating ends of the insulator housing and contacts of the second electrical connector being received in corresponding channels of the module of the first electrical connector when the first and second electrical connectors are mated, the module of the first electrical connector providing electrical shielding for the mating ends of the insulator housings and contacts of the second electrical connector.

* * * * *